US005641303A

United States Patent [19]

Chiu

[11] Patent Number: 5,641,303

[45] Date of Patent: Jun. 24, 1997

[54] LAMP SOCKET

[76] Inventor: Pen-Li Chiu, No. 72, Alley 6, Lane 315, Chung Cheng North Rd., Sanchung City, Taipei Hsien, Taiwan

[21] Appl. No.: 502,670

[22] Filed: Jul. 14, 1995

[51] Int. Cl.[6] ..... H01R 4/24

[52] U.S. Cl. ..... 439/419; 439/665

[58] Field of Search ..... 439/665, 417–419, 439/395, 404

[56] References Cited

U.S. PATENT DOCUMENTS

| | | | |
|---|---|---|---|
| 3,251,023 | 5/1966 | Schick | 439/665 |
| 5,421,742 | 6/1995 | Huang | 439/419 |
| 5,518,425 | 5/1996 | Tsai | 439/419 |
| 5,531,609 | 7/1996 | Cheng et al. | 439/419 |

*Primary Examiner*—David L. Pirlot

*Attorney, Agent, or Firm*—Varndell Legal Group

[57] ABSTRACT

A lamp socket including a socket body to hold a lamp bulb, a socket cap fastened to the socket body to hold down the electric wire, a central metal contact plate and side metal contact plate fastened to the socket body to connect the tip contact and ring contact of the lamp bulb to a respective conductor in the electric wire. The side metal contact plate has a longitudinal projecting spring strip raised from one side and then turned longitudinally downward toward the orifice of the socket body, which projecting spring strip is disposed in contact with the ring contact of the lamp bulb to give it an inward pressure when the lamp bulb is threaded into the socket body.

2 Claims, 5 Drawing Sheets

LAMP SOCKET

BACKGROUND AND SUMMARY OF THE INVENTION

The present invention relates to lamp sockets, and relates more particularly to the side metal contact plate for lamp sockets which has a contact spring strip disposed in contact with the side contact of the bulb to give it an inward pressure.

A regular lamp socket is generally comprised of a socket body, a lamp bulb threaded into the socket body, a central metal contact plate and a side metal contact plate respectively fastened to a respective contact slot in said socket body to make electrical contact with the tip contact and ring contact of the lamp bulb respectively, and a socket cap fastened to the socket body to hold down an electric wire. The central metal contact plate and the side metal contact plate have a respective pointed tip extended out of the socket body and pierced the insulator of the electrical wire to make electrical contact with a respective conductor in the electric wire. The side metal contact plate has two raised portions for engagement with the spiral groove on the ring contact of the lamp bulb. However, if the raised portions of the side metal contact plate are not accurately engaged with the spiral groove on the ring contact of the lamp bulb, the contact between the side metal contact plate and the ring contact of the lamp bulb becomes unstable. When this problem happens, the lamp bulb will flash and produce heat.

The present invention has been accomplished to eliminate the aforesaid problem. According to the present invention, the side metal contact plate has a longitudinal projecting spring strip raised from one side and then turned longitudinally downward toward the orifice of the socket body, which projecting spring strip being disposed in contact with the ring contact of the lamp bulb to give it an inward pressure when the lamp bulb is threaded into the socket body. Therefore, the contact between the lamp bulb and the side metal contact plate is ensured.

DETAILED DESCRIPTION OF THE PREFERRED EMBODIMENT

Figure 1:
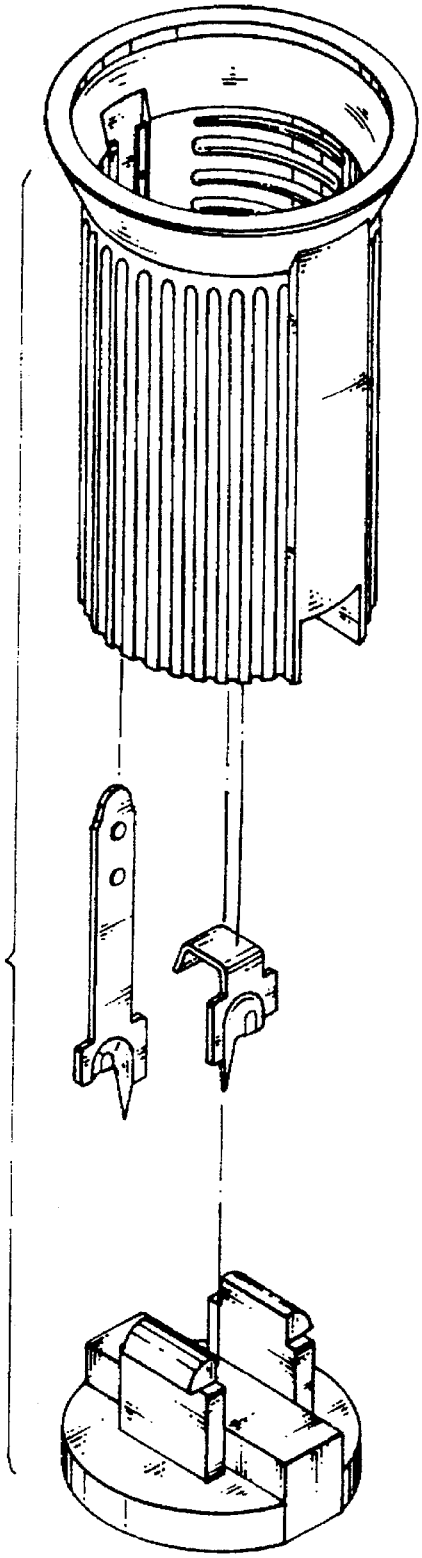
Fig. 1 PRIOR ART
FIG. 1 is an exploded view of a lamp socket according to the prior art.
Figure 2:
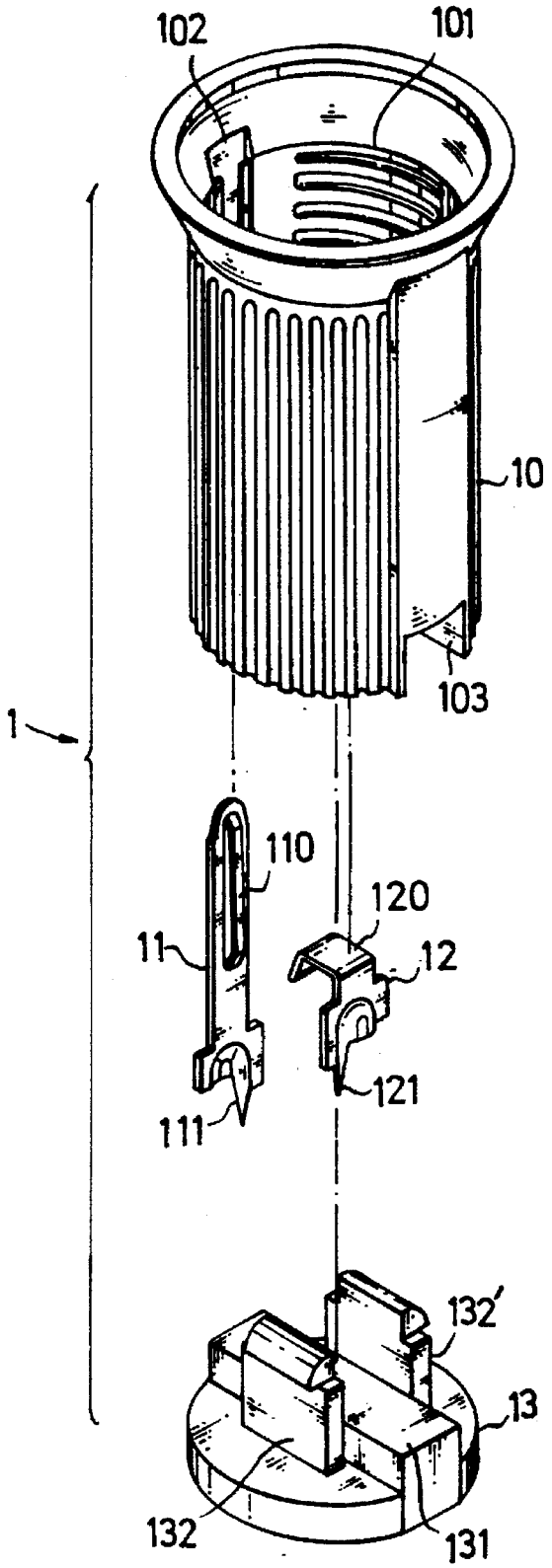
FIG. 2 is an exploded view of a lamp socket according to the present invention.
Figure 3:
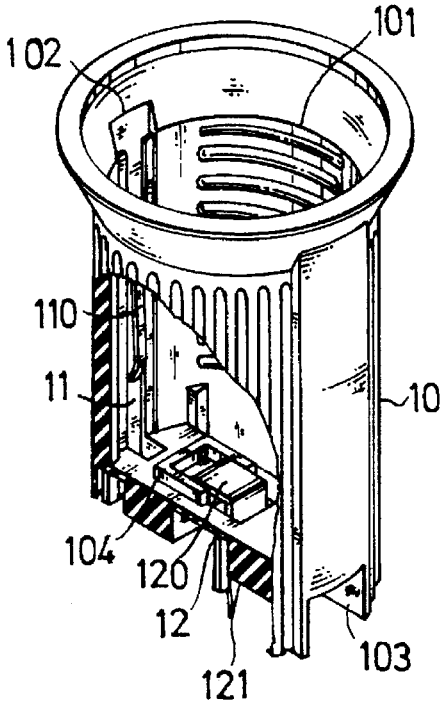
FIG. 3 is a cutaway of the socket body showing the metal contact plates installed according to the present invention.
Figure 4:
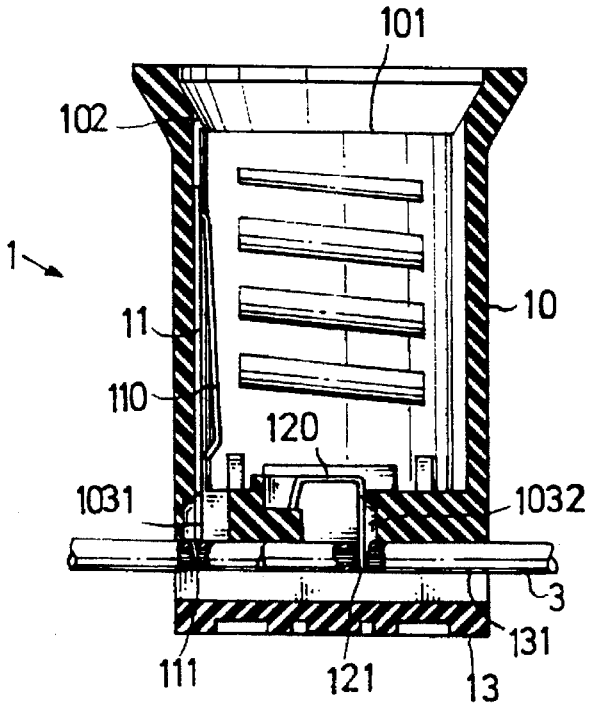
FIG. 4 is a longitudinal view in section of the lamp socket according to the present invention.
Figure 5:
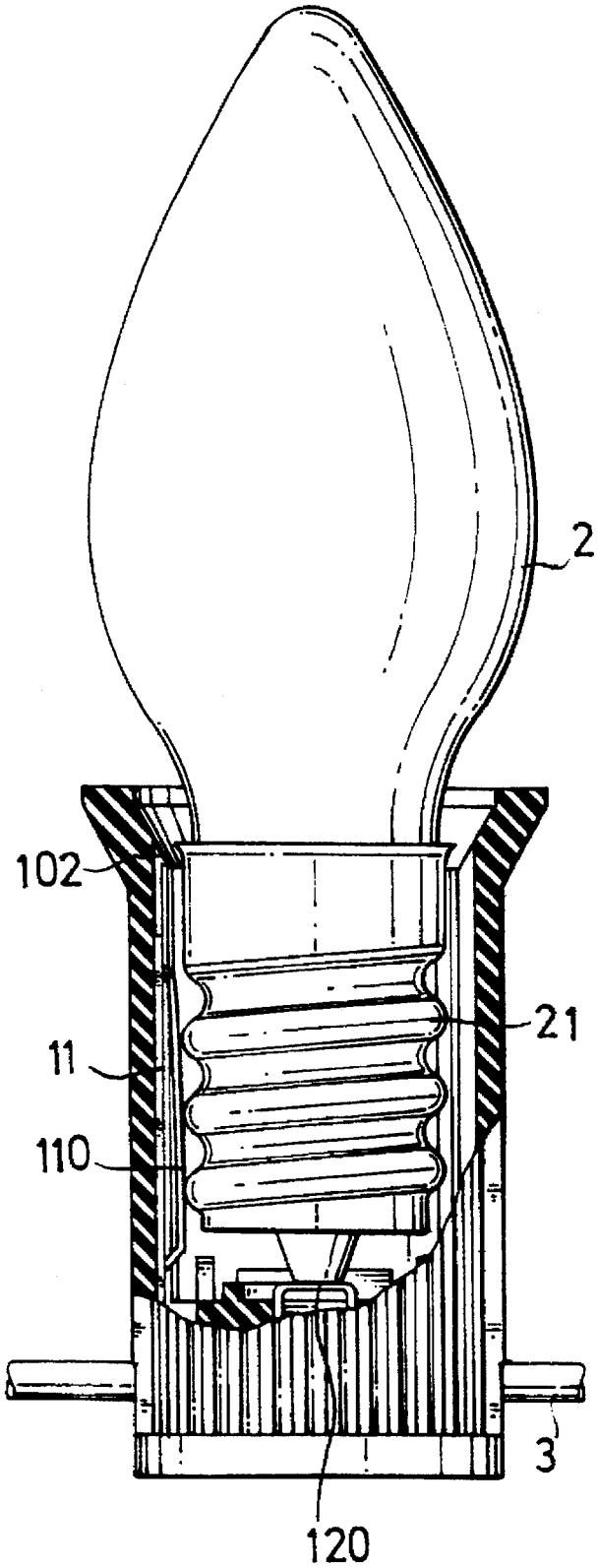
FIG. 5 is a sectional view of the lamp socket according to the present invention, showing the lamp bulb installed.

Referring to Figures from 2 to 5, a lamp socket, referenced by 1, is generally comprised of a socket body 10, a side metal contact plate 11, a central metal contact plate 12, and a socket cap 13. The socket body 10 is made of cylindrical shape having threads 101 on the inside for mounting a lamp bulb 2, a longitudinal inside groove 102 for mounting the side metal contact plate 12, a transverse wire groove 103 at the bottom on the outside for mounting an electric wire 3, two contact slots 1031 and 1032 communicating with the wire groove 103 and through which the pointed tips 111 and 121 of the side metal contact plate 11 and the central metal contact plate 12 respectively pass and then pierce the insulator of the electric wire 3 to make electrical contact with a respective conductor in the electric wire 3. The side metal contact plate 11 is made of elongated shaped fastened to the longitudinal groove 102 of the socket body 10 to make electrical contact with the ring contact of the lamp bulb 2, having a pointed tip 111 at one end inserted from within the inside of the socket body 10 through one contact slot 1031 and piercing the insulator of the electrical wire 3 to make electrical contact with one conductor in the electric wire 3. The central metal contact plate 12 has a bend 120 at one end bridged over a bearing portion 104 at the bottom of the socket body 10 on the inside to make electrical contact with the tip contact of the lamp bulb 2, and a pointed tip 121 at an opposite end inserted through one contact slot 1032 and piercing the insulator of the electric wire 3 to make electrical contact with another conductor in the electric wire 3. The socket cap 13 is made of circular shape having a rectangular block 131 transversely disposed at the bottom side in the middle and fitted into the wire groove 103 of the socket body 10 to hold down the electrical wire 3, and two parallel hooks 132 and 132' perpendicularly extended from the bottom side and respectively hooks in a respective hook hole (not shown) in the socket body 10. The main feature of the present invention is at the side metal contact plate 11. The side metal contact plate 11 has a longitudinal projecting spring strip 110 raised from one side and then turned longitudinally downward in the reversed direction relative to the pointed tip 111 when the lamp bulb 2 is threaded into the threads 101 of the socket body 10, the longitudinal projecting spring strip 110 is disposed in contact with the ring contact of the lamp bulb 2 to give it an inward pressure, and therefore the lamp bulb 2 is firmly retained in position.

Figure 6:
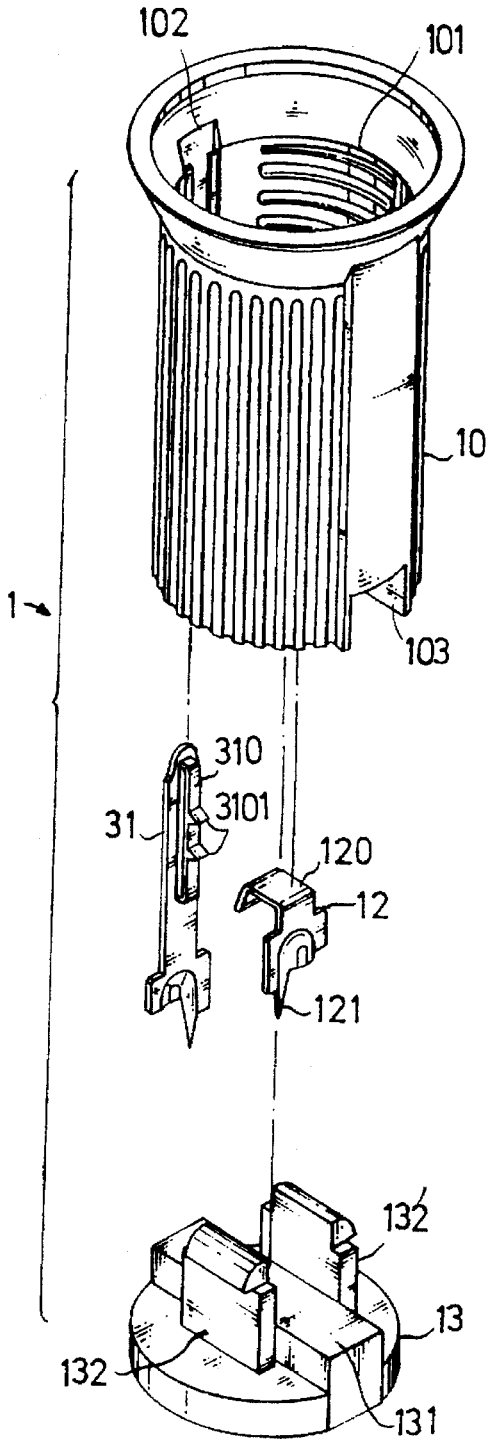
FIG. 6 is an exploded view of an alternate form of the present invention.
Figure 7:
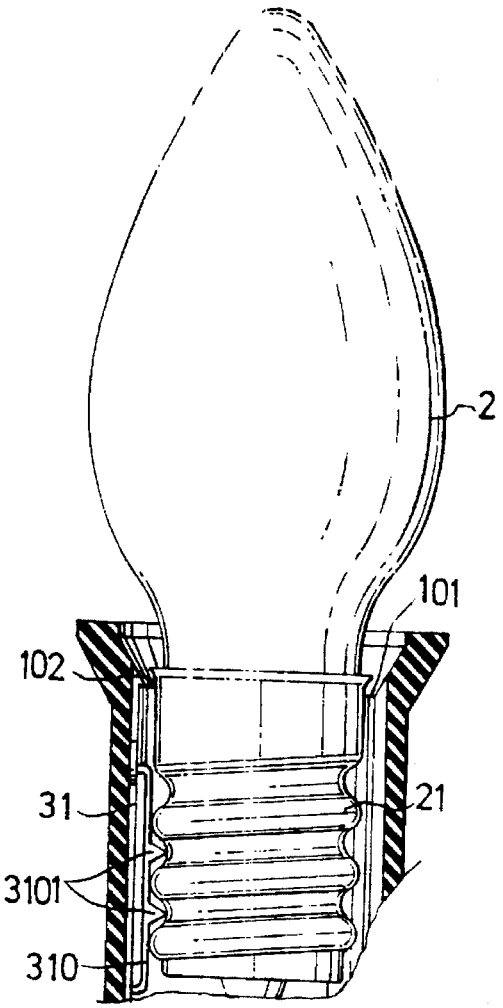
FIG. 7 is a sectional view of the alternate form of FIG. 6, showing the lamp bulb installed.

FIGS. 6 and 7 shown an alternate form of the present invention, in which the side metal contact plate 31 has a longitudinal projecting spring strip 310 at one side, which projecting spring strip 310 has a corrugated contact surface 3101 fitting the configuration of the ring contact 21 of the lamp bulb 2.

I claim:

1. A lamp socket comprising a socket body with a bottom, a lamp bulb threaded into said socket body, a socket cap, a central metal contact plate and a side metal contact plate; said lamp bulb having a tip contact and a ring contact; said socket body having a bottom bearing portion, and a central groove and a side groove respectively receiving and securing said central and side contact plates; said central and side metal contact plates respectively arranged to contact said tip contact and said ring contact of said lamp bulb, said central and side metal contact plates respectively having a pointed tip extended out of said socket body toward said socket cap, said socket cap fastened to the socket body and holding an electric wire therebetween for permitting said pointed tips of said central and side metal contact plate to pierce an insulator of said electrical wire and to make electrical contact with a respective conductor in said electrical wire, said side metal contact plate has a base plate and a U-shaped longitudinal projecting spring strip extending from said base, a bottom of said U-shaped longitudinal projecting spring strip arranged to contact said ring contact of said lamp, and sides of said U-shaped longitudinal projecting spring strip extending toward said side groove of said socket body and resiliently biasing said bottom of said U-shaped longitudinal projecting spring strip inward, and said central metal contact plate having an inverted-J shape with a short side, a long side, and a middle joining said short and long side, said middle arranged to contact said tip contact of said lamp, said long side having said pointed tip and secured in said central groove, and said short side supported on said bottom bearing portion of said socket body for resiliently biasing said middle of said central metal contact plate upward.

2. The lamp socket of claim 1, wherein said bottom of said U-shaped longitudinal projecting spring strip has a corrugated contact surface with projections having a triangular cross-section extending inwardly.

* * * * *